US011933559B2

(12) United States Patent
Mann

(10) Patent No.: US 11,933,559 B2
(45) Date of Patent: Mar. 19, 2024

(54) FIREARM SAFETY CONTROL SYSTEM

(71) Applicant: Allan Mann, Orlando, FL (US)

(72) Inventor: Allan Mann, Orlando, FL (US)

( * ) Notice: Subject to any disclaimer, the term of this patent is extended or adjusted under 35 U.S.C. 154(b) by 0 days.

(21) Appl. No.: 17/816,537

(22) Filed: Aug. 1, 2022

(65) Prior Publication Data

US 2023/0037964 A1 Feb. 9, 2023

Related U.S. Application Data

(60) Provisional application No. 63/230,978, filed on Aug. 9, 2021.

(51) Int. Cl.
*F41A 17/06* (2006.01)

(52) U.S. Cl.
CPC ..... *F41A 17/066* (2013.01); *F41A 17/063* (2013.01)

(58) Field of Classification Search
CPC ..... F41A 17/06; F41A 17/063; F41A 17/066
See application file for complete search history.

(56) References Cited

U.S. PATENT DOCUMENTS 6,823,621 B2 * 11/2004 Gotfried ..... F41A 17/066 42/70.01
9,803,942 B2 * 10/2017 Milde, Jr. ..... F41A 17/08
10,175,018 B1 * 1/2019 Campagna ..... H04N 23/57
10,260,830 B2 * 4/2019 Hafen ..... F41A 17/063
10,365,057 B2 * 7/2019 Black ..... F41J 5/10
10,591,237 B1 * 3/2020 Cannon ..... F41A 17/066
10,837,723 B2 * 11/2020 Black ..... G08B 15/004
10,845,146 B2 * 11/2020 Campagna ..... G06V 40/168
10,976,122 B2 * 4/2021 Hafen ..... F41A 17/063
11,156,419 B1 * 10/2021 Wang ..... F41G 1/35
2002/0112390 A1 * 8/2002 Harling ..... H04K 3/20 42/70.11
2011/0162514 A1 * 7/2011 Osborne ..... F41H 13/0018 224/191
2015/0369554 A1 * 12/2015 Kramer ..... H04N 9/806 386/227
2016/0165192 A1 * 6/2016 Saatchi ..... H04N 7/185 386/227
2017/0010062 A1 * 1/2017 Black ..... F41J 5/10
2017/0284754 A1 * 10/2017 Chakraborty ..... F41A 17/066
2019/0011206 A1 * 1/2019 Campagna ..... G06V 40/172
2019/0137219 A1 * 5/2019 Bockmon ..... F41G 5/16
2019/0212087 A1 * 7/2019 Campagna ..... H04N 23/45
2020/0355456 A1 * 11/2020 Deng ..... H04N 23/66

* cited by examiner

*Primary Examiner* — Joshua E Freeman
(74) *Attorney, Agent, or Firm* — Brennan, Manna & Diamond, LLC

(57) ABSTRACT

The present invention relates to a firearm safety control system. The system is primarily comprised of at least one camera, at least one image recognition software, at least one artificial intelligence software, and at least one disabling mechanism. Using the camera, the image recognition software detects and classifies a target. The artificial intelligence software then determines what lethality mode the target can be engaged at. If a user attempts to engage an area of the target not permitted by the current lethality mode, the firearm will become disabled and will not fire.

13 Claims, 3 Drawing Sheets

FIREARM SAFETY CONTROL SYSTEM

CROSS-REFERENCE TO RELATED APPLICATION

The present application claims priority to, and the benefit of, U.S. Provisional Application No. 63/230,978, which was filed on Aug. 9, 2021, and is incorporated herein by reference in its entirety.

FIELD OF THE INVENTION

The present invention relates generally to the field of firearm safety. More specifically, the present invention relates to a firearm safety control system. The system is primarily comprised of at least one camera, at least one image recognition software, at least one artificial intelligence software, and at least one disabling mechanism. Using the camera, the image recognition software detects and classifies a target. The artificial intelligence software then determines what lethality mode the target can be engaged at. If a user attempts to engage an area of the target not permitted by the current lethality mode, the firearm will become disabled and will not fire. Accordingly, the present disclosure makes specific reference thereto. Nonetheless, it is to be appreciated that aspects of the present invention are also equally applicable to other like applications, devices, and methods of manufacture.

BACKGROUND

Many firearms are unintentionally discharged. This can lead to the serious injury and/or death of nearby individuals or the individual who discharged the firearm. Further, law enforcement or untrained individuals may unintentionally shoot and seriously injure or kill nearby individuals due to poor aim.

Therefore, there exists a long-felt need in the art for a means to prevent firearms from being unintentionally discharged. There also exists a long-felt need in the art for a firearm safety control system that prevents a firearm from being unintentionally discharged and shooting a nearby individual. Further, there exists a long-felt need in the art for a firearm safety control system that prevents a firearm from being unintentionally discharged and shooting a nearby individual by preventing the firearm from firing.

The subject matter disclosed and claimed herein, in one embodiment thereof, comprises a firearm safety control system. The system is primarily comprised of at least one camera, at least one image recognition software, at least one artificial intelligence software, at least one chipset, at least one micro-controller, at least one processor, at least one memory storage device, and at least one disabling mechanism. The system can be used with any firearm known in the art, wherein the system prevents the firearm from firing. Using the camera, the image recognition software detects and classifies a target. The artificial intelligence software then determines what lethality mode the target can be engaged at. If a user attempts to engage an area of the target not permitted by the current lethality mode, the firearm will become disabled via the disabling system and will not fire.

In this manner, the firearm safety control system of the present invention accomplishes all of the foregoing objectives and provides a means to prevent firearms from being unintentionally discharged. To do so, the firearm safety control system prevents a firearm from being unintentionally discharged and shooting a nearby individual. This is accomplished by preventing the firearm from firing.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a firearm safety control system. The system is primarily comprised of at least one camera, at least one image recognition software, at least one artificial intelligence software, at least one chipset, at least one micro-controller, at least one processor, at least one memory storage device, and at least one disabling mechanism. The system can be used with any firearm known in the art, wherein the system prevents the firearm from firing.

The system has a plurality of targeting modes and lethality levels that can be accomplished using the camera, image recognition software, and artificial intelligence software, among other components of the system. The camera is preferably positioned on some area of the firearm. The image recognition software detects at least one target type via the feed from the camera and then classifies the target detected into one of at least three categories. A non-human target includes, but is not limited to, non-living objects or animals. An armed target includes, but is not limited to, a human with a firearm or other weapon (i.e., knife, blunt object, etc.). An unarmed person includes, but is not limited to, any human that does not possess a weapon. The camera is preferably positioned on the firearm parallel with the barrel of the firearm such that the camera constantly faces the area where the barrel points to detect any targets within said area automatically (i.e., the camera can detect anything the firearm is pointed at).

The image recognition software is monitored by the artificial intelligence software. In response to the target mode identified by the image recognition software, the intelligence software automatically places the firearm into at least one lethality mode such as lethal mode, disable mode, and non-contact mode. The lethality modes designate a plurality of areas of the target that can and cannot be fired at, with respect to each target mode. When a user attempts to fire at a target in an area not permitted by the current lethality mode, the intelligence software will activate a disabling mechanism within the firearm to temporarily disable the firearm from firing.

Accordingly, the firearm safety control system of the present invention is particularly advantageous as it provides a means to prevent firearms from being unintentionally discharged. In addition, the system prevents a firearm from being unintentionally discharged and shooting a nearby individual. This is accomplished by preventing the firearm from firing. In this manner, the firearm safety control system overcomes the limitations of existing firearms known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
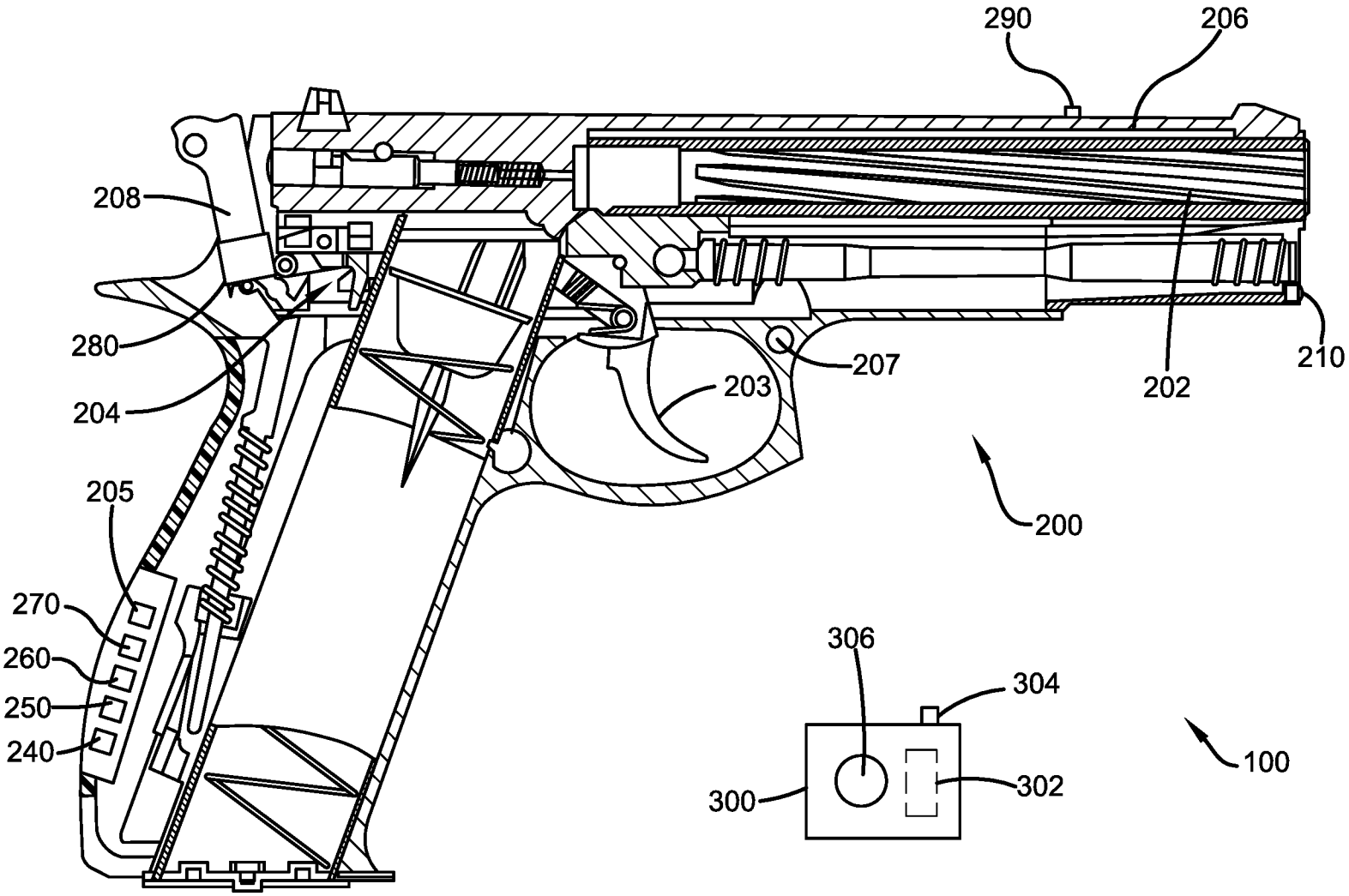
FIG. 1 illustrates a cross-sectional view of one potential embodiment of a firearm safety control system while integrated with a firearm of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a means to prevent firearms from being unintentionally discharged. There also exists a long-felt need in the art for a firearm safety control system that prevents a firearm from being unintentionally discharged and shooting a nearby individual. Further, there exists a long-felt need in the art for a firearm safety control system that prevents a firearm from being unintentionally discharged and shooting a nearby individual by preventing the firearm from firing.

The present invention, in one exemplary embodiment, is comprised of a firearm safety control system primarily comprised of at least one camera, at least one image recognition software, at least one artificial intelligence software, at least one chipset, at least one micro-controller, at least one processor, at least one memory storage device, and at least one disabling mechanism. The system can be used with any firearm known in the art, wherein the system prevents the firearm from firing.

The system has a plurality of targeting modes and lethality levels that can be accomplished using the camera, image recognition software, and artificial intelligence software, among other components of the system. The camera is preferably positioned on some area of the firearm, wherein the image recognition software detects at least one target type via the feed from the camera and then classifies the target detected into one of at least three categories. The categories include a non-human target which includes, but is not limited to, non-living objects or animals, an armed target includes, but is not limited to, a human with a firearm or other weapon (i.e., knife, blunt object, etc.), and an unarmed person includes, but is not limited to, any human that does not possess a weapon. The camera is preferably positioned on the firearm parallel with the barrel of the firearm such that the camera constantly faces the area where the barrel points to detect any target within said area automatically (i.e., the camera can detect anything the firearm is pointed at).

The image recognition software is monitored by the artificial intelligence software. In response to the target mode identified by the image recognition software, the intelligence software automatically places the firearm into at least one lethality mode, such as lethal mode, disable mode, and non-contact mode. The lethality modes designate a plurality of areas of the target that can and cannot be fired at, with respect to each target mode. When a user attempts to fire at a target type in an area not permitted by the current lethality mode, the intelligence software will activate a disabling mechanism within the firearm to temporarily disable the firearm from firing.

Accordingly, the firearm safety control system of the present invention is particularly advantageous as it provides a means to prevent firearms from being unintentionally discharged. In addition, the system prevents a firearm from being unintentionally discharged and shooting a nearby individual. This is accomplished by preventing the firearm from firing. In this manner, the firearm safety control system overcomes the limitations of existing firearms known in the art.

Referring initially to the drawings, FIG. 1 illustrates a cross-sectional view of one potential embodiment of a firearm safety control system 100 while integrated with a firearm 200 of the present invention in accordance with the disclosed architecture. The system 100 is primarily comprised of at least one camera 210, at least one image recognition software 220, at least one artificial intelligence software 230, at least one chipset 240, at least one micro-controller 250, at least one processor 260, at least one memory storage device 270, and at least one disabling mechanism 280. The system 100 can be used with any firearm 200 known in the art, wherein the system 100 prevents the firearm 200 from firing. The term firearm 200 intends to describe any device capable of firing a projectile, object, compound, laser, chemical, water, or fire. This includes, but is not limited to: pistols, rifles, shotguns, etc. The system 100 may also be used with non-lethal projectile firing devices such as, but not limited to, stun-guns, pepper spray shooting devices, rubber bullet shooting devices, gas firing devices, etc., wherein the system 100 prevents the projectile from being fired.

The system 100 has a plurality of targeting modes 232 and lethality levels 234 that can be accomplished using the camera 210, image recognition software 220, and artificial intelligence software 220, among other components of the system 100. The camera 210 (or in a differing embodiment, any device that is capable of capturing an image or video) is preferably positioned on some area of the firearm 200. The camera 210 may be removably attached to the firearm 200 or may be integrally formed to the firearm 200. In various embodiments, the camera 210 may be a plurality of camera types such as, but not limited to, an HD camera, an infrared camera, a thermal camera, a night-vision camera, an X-ray camera, a laser camera, etc. The camera 210 provides at least one photo and/or a continuous live video feed to the system 100 to allow the software 220,230 to analyze and operate the system 100 in response. The camera 210 is preferably in wired or wireless electrical communication with the chipset 240, micro-controller 250, processor 260, and memory 270, which are all preferably housed within the firearm 200 or removably attached to the firearm 200.

Figure 2:
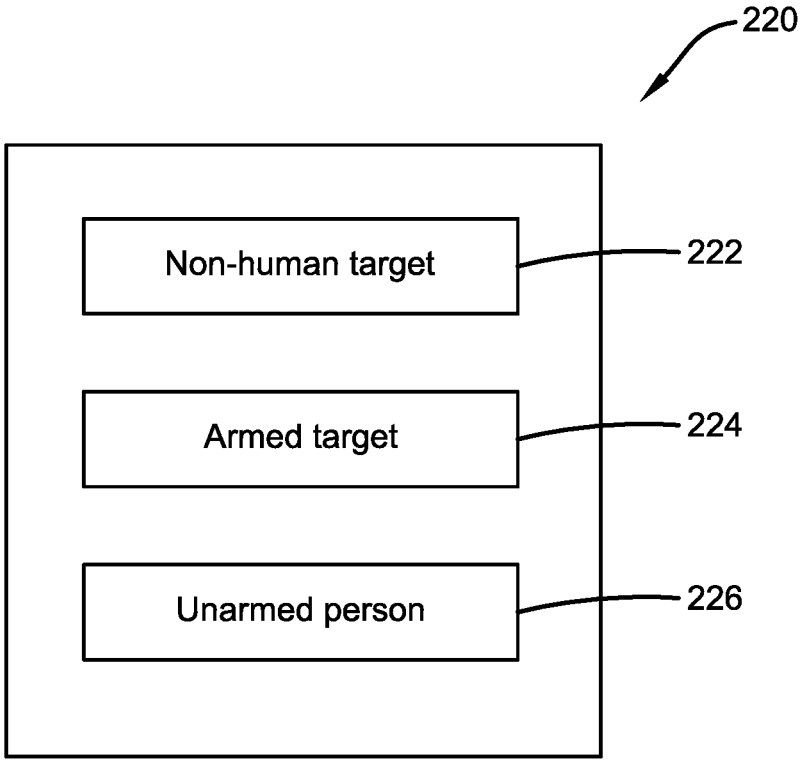
FIG. 2 illustrates a graphical illustration of one potential embodiment of target classifications of image recognition software of a firearm safety control system of the present invention in accordance with the disclosed architecture.

FIG. 2 illustrates a graphical illustration of one potential embodiment of target classifications of image recognition software 220 of a firearm safety control system 100 of the present invention in accordance with the disclosed architecture. The image recognition software 220 detects at least one target type via the feed from the camera 210. The software 220 then classifies the target detected into one of at least three categories. A non-human target 222 includes, but is not limited to, non-living objects or animals. An armed target 224 includes, but is not limited to, a human with a firearm or other weapon (i.e., knife, blunt object, etc.). In one embodiment, the software 220 can be programmed to identify any specific item as a weapon. An unarmed person 226 includes, but is not limited to, any human that does not possess a weapon, wherein the concept and identification of what constitutes a weapon is programmed into the software 220. The camera 210 is preferably positioned on the firearm 200 parallel with the barrel 202 of the firearm 200. In this manner, the camera 210 constantly faces the area where the barrel 202 points to detect any targets 222,224,226 within said area automatically (i.e., the camera 210 can detect anything the firearm 200 is pointed at).

Figure 3:
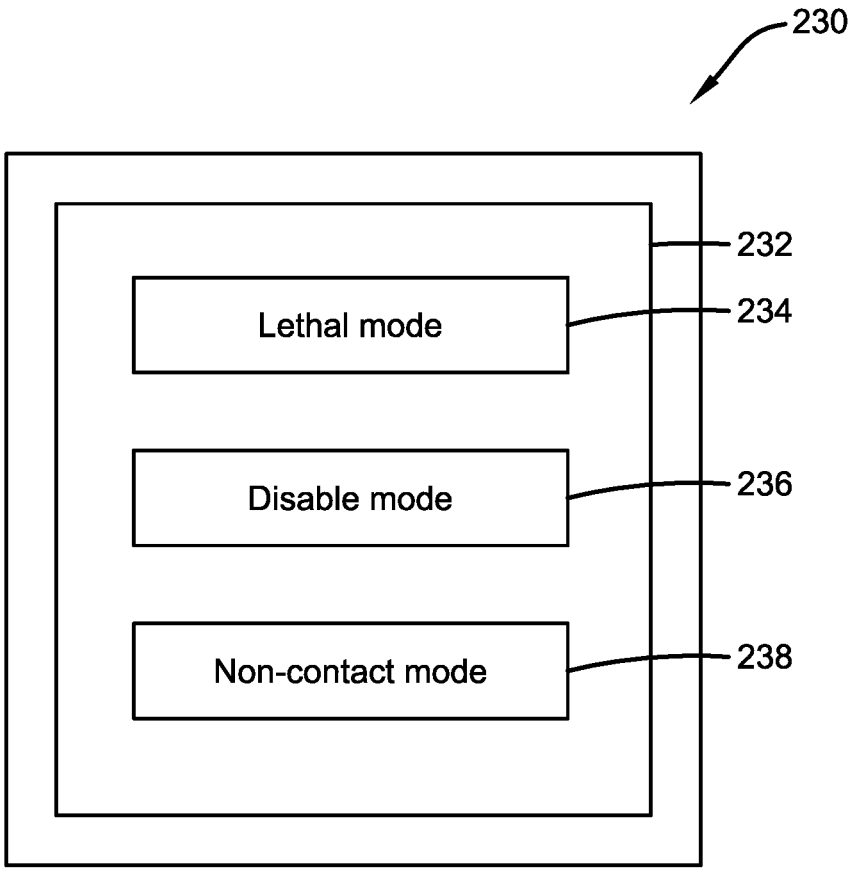
FIG. 3 illustrates a graphical illustration of one potential embodiment of lethality modes of artificial intelligence software of a firearm safety control system of the present invention in accordance with the disclosed architecture.

FIG. 3 illustrates a graphical illustration of one potential embodiment of lethality modes 232 of the artificial intelligence software 230 of a firearm safety control system 100 of the present invention in accordance with the disclosed architecture. The image recognition software 220 is monitored by the artificial intelligence software 230. In response to the target mode 222,224,226 identified by the image recognition software 220, the intelligence software 230 automatically places the firearm 200 into at least one lethality mode 232. The lethality modes 232 may include, but are not limited to, lethal mode 234, disable mode 236, and non-contact mode 238.

For the following programming rules of each mode 222, 224,226, the following definitions apply.

Lethal area-center mass of the target's body (i.e., head, chest, stomach). Shooting this area is intended to kill, critically injure, or completely disable (immobilize) the target.

Disable area-any area of the target's body that is not the lethal area. Shooting this area is intended to injure the target but with a lower chance of causing critical or fatal injury than shooting the lethal area. Further, the intention of shooting this area is to stop or slow down the target, but not to kill or critically injure the target.

Non-contact area—the area around the target that is not the target. Shooting this area is intended to provide a warning shot and has a low chance of direct contact with the target or any nearby individuals or animals.

Under non-human target mode 222, the intelligence software 230 allows the firearm 200 to behave as follows:

1. In non-human target 222, non-contact mode 238, the intelligence software 230 will allow the firearm 200 to fire at a non-contact area of the non-human target.
2. In non-human target 222, disable mode 236, the intelligence software 230 will allow the firearm 200 to fire at a non-contact area or a disabled area of the non-human target.
3. In non-human target 222, lethal mode 234, the intelligence software 230 will allow the firearm 200 to fire at a non-contact area, a disabled area, or a lethal area of the non-human target.

Under armed target mode 224, the intelligence software 230 allows the firearm 200 to behave as follows:

1. In armed target 224, non-contact mode 238, the intelligence software 230 will allow the firearm 200 to fire at a non-contact area of the armed target.
2. In armed target 224, disable mode 236, the intelligence software 230 will allow the firearm 200 to fire at a non-contact area or the disabled area of the armed target.
3. In armed target 224, lethal mode 234, the intelligence software 230 will allow the firearm 200 to fire at a non-contact area, the lethal area, or the disabled area of the armed target.

Under unarmed mode 226, the intelligence software 230 allows the firearm 200 to behave as follows:

1. In unarmed target 226, non-contact mode 238, the intelligence software 230 will allow the firearm 200 to fire at a non-contact area of the unarmed target.
2. In unarmed target 226, disable mode 236, the intelligence software 230 will allow the firearm 200 to fire at a non-contact area or the disabled area of the unarmed target.
3. In unarmed target 226, lethal mode 234, the intelligence software 230 will allow the firearm 200 to fire at a non-contact area, the lethal area, or the disabled area of the unarmed target.

The various lethality modes 232 are automatically determined by the intelligence software 230 by considering a plurality of factors such as, but not limited to, distance to target, speed of target, movement of target, height of target, proximity of target to nearby individuals, etc. These factors can be detected by the camera 210 and identified by the image recognition software 220 which communicates said identifications to the intelligence software 230. The chipset 240, micro-controller, processor, and memory 270 allow the camera 210, recognition software 220, and intelligence software 230 to communicate.

When a user attempts to fire at a target 222,224,226 in an area of the target 222,224, 226 not permitted by the current lethality mode 232, the intelligence software 230 will activate a disabling mechanism 280 within the firearm 200 to temporarily disable the firearm 200. By way of example, while in unarmed target mode 226, if a user attempts to fire at the unarmed target in the lethal area or disable area of the target, the disabling mechanism 280 will be activated to prevent the firearm 200 from firing. In various embodiments, the disabling mechanism 280 may contract and temporarily render the trigger 203, firing pin 204, hammer 208, and/or slide 206 of the firearm 200 inoperable to prevent the firearm 200 from firing as needed. It should be noted that this system 100 cannot acuate the firearm 200 to fire, only prevent the firearm 200 from firing.

In one embodiment, the software 220, 230 can be turned on or off from a firearm using at least one button 207 and/or switch located on the firearm 200. In one embodiment, the button 207 is not present and the software 220,230 is permanently configured to the firearm 200. In another embodiment, the software 220, 230 can be turned on/off or controlled by at least one controller 300 via at least one button 306 with at least one transmitter 304 that is in wireless electrical communication with the processor 260 via at least one wireless receiver/transmitter antenna 290 located on or in the firearm 200. The components of the system 100 within the firearm 200 and the controller 300 may further be powered via at least one battery 205,302 or other alternative power source such as but not limited to a solar panel. The battery 205,302 may be a disposable battery 205,302 or a rechargeable battery 205,302 in the form of an alkaline, nickel-cadmium, nickel-metal hydride battery 205, 302, etc., such as any 3V-12 volts DC battery 205,302 or other conventional battery 205,302 such as A, AA, AAA, etc., that supplies power to the device 100. Throughout this specification the terms "battery" and "batteries" may be used interchangeably to refer to one or more wet or dry cells or batteries 205,302 of cells in which chemical energy is converted into electricity and used as a source of DC power. References to recharging or replacing batteries 205,302 may refer to recharging or replacing individual cells, individual batteries 205,302 of cells, or a package of multiple battery cells as is appropriate for any given battery 205,302 technology that may be used.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "firearm safety control system" and "system" are interchangeable and refer to the firearm safety control system 100 of the present invention.

Notwithstanding the foregoing, the firearm safety control system 100 of the present invention and its various components can be of any suitable size and configuration as is known in the art without affecting the overall concept of the invention, provided that they accomplish the above-stated objectives. One of ordinary skill in the art will appreciate that the size, configuration, and material of the firearm safety control system 100 as shown in the FIGS. are for illustrative purposes only, and that many other sizes and shapes of the firearm safety control system 100 are well within the scope of the present disclosure. Although the dimensions of the firearm safety control system 100 are important design parameters for user convenience, the firearm safety control system 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A firearm safety control system comprising:

a firearm;

a camera;

an image recognition software that places a target into a select one of a non-human target classification, an armed target classification, or an unarmed target classification;

an artificial intelligence software comprised of a lethal mode, a disable mode, and a non-contact mode;

a disabling mechanism that prevents the firearm from firing when in the disable mode;

a chipset;

a micro-controller;

a processor; and a memory.

2. The firearm safety control system of claim 1, wherein the camera is an HD camera, an infrared camera, a thermal camera, a night-vision camera, X-ray camera, or a laser camera.

3. The firearm safety control system of claim 1, wherein the firearm is a pistol, a rifle, or a shotgun.

4. The firearm safety control system of claim 1, wherein the artificial intelligence software places the firearm into the lethal mode, the disable mode, or the non-contact mode based on the target classification created by the image recognition software.

5. The firearm safety control system of claim 1, wherein the lethal mode allows a user to shoot the firearm such that they can kill, critically injure, or completely disable the target.

6. The firearm safety control system of claim 1, wherein the disable mode allows a user to shoot the firearm such that they can shoot the target in a non-lethal area.

7. The firearm safety control system of claim 1, wherein the non-contact mode allows a user to shoot the firearm such that they cannot shoot the target.

8. The firearm safety control system of claim 1 further comprised of a remote control.

9. The firearm safety control system of claim 8, wherein the remote control is in wireless electrical communication with the processor via an antenna.

10. The firearm safety control system of claim 1, wherein the disabling mechanism contacts a trigger, a firing pin, a hammer, or a slide of the firearm.

11. The firearm safety control system of claim 1 further comprised of a battery or an alternative power source.

12. The firearm safety control system of claim 1, wherein the camera is positioned parallel with a barrel of the firearm.

13. The firearm safety control system of claim 1, wherein the camera is integrally formed to the firearm.

* * * * *